US006659458B1

(12) United States Patent
Peters et al.

(10) Patent No.: US 6,659,458 B1
(45) Date of Patent: Dec. 9, 2003

(54) PERPETUAL SEAL CARD GAME

(76) Inventors: Mark Peters, 312 Crownview Ct., San Marcos, CA (US) 92069; Lisa Peters, 312 Crownview Ct., San Marcos, CA (US) 92069

( * ) Notice: Subject to any disclaimer, the term of this patent is extended or adjusted under 35 U.S.C. 154(b) by 0 days.

(21) Appl. No.: 10/223,909

(22) Filed: Aug. 20, 2002

(51) Int. Cl.[7] ..... A63F 3/06

(52) U.S. Cl. ..... 273/138.1; 273/252; 283/903; 463/16; 463/17; 463/18; 463/19; 463/25

(58) Field of Search ..... 273/138.1, 139, 273/292; 283/903; 463/16, 17, 18, 19, 25

(56) References Cited

U.S. PATENT DOCUMENTS

| | | | | | |
|---|---|---|---|---|---|
| 3,900,219 | A | * | 8/1975 | D'Amato et al. | 283/101 |
| 4,943,090 | A | * | 7/1990 | Fienberg | 273/139 |
| 5,046,737 | A | * | 9/1991 | Fienberg | 273/139 |
| 5,407,199 | A | * | 4/1995 | Gumina | 273/139 |
| 5,407,200 | A | * | 4/1995 | Zalabak | 273/139 |
| 5,562,284 | A | * | 10/1996 | Stevens | 273/139 |
| 5,647,592 | A | * | 7/1997 | Gerow | 273/139 |
| 5,657,991 | A | * | 8/1997 | Camarato | 273/269 |
| 5,671,921 | A | * | 9/1997 | Quinlan | 273/139 |
| 5,788,237 | A | * | 8/1998 | Fults et al. | 273/269 |
| 5,934,671 | A | * | 8/1999 | Harrison | 273/139 |
| 5,949,042 | A | * | 9/1999 | Dietz et al. | 235/375 |
| 6,186,502 | B1 | * | 2/2001 | Perkins | 273/138.1 |
| 6,234,477 | B1 | * | 5/2001 | Scrymgeour et al. | 273/139 |
| 6,241,246 | B1 | * | 6/2001 | Guttin et al. | 273/139 |
| RE37,371 | E | * | 9/2001 | Gerow | 273/139 |
| 6,309,298 | B1 | * | 10/2001 | Gerow | 463/20 |
| 6,347,794 | B2 | * | 2/2002 | Scrymgeour et al. | 273/138.1 |
| 6,390,916 | B1 | * | 5/2002 | Brown | 463/17 |
| 6,435,500 | B2 | * | 8/2002 | Gumina | 273/139 |
| 6,447,395 | B1 | * | 9/2002 | Stevens | 463/18 |

OTHER PUBLICATIONS

A. Gumina—Pub. No.: US 2001/0019193 A1—Interactive Games and Method of Playing—Sep. 6, 2001.*

J. E. Gerow—Pub. No.: US 2002/0072404 A1—Method, Apparatus and Gaming Set for Use in a Progressive Game—Jun. 13, 2002.*

D. A. Such—Pub. No.: US 2003/0067109 A1 _Game Using Combined Coin Board and Seal Card Creating an Action Board—Apr. 10, 2003.*

* cited by examiner

*Primary Examiner*—Benjamin H. Layno
*Assistant Examiner*—Dolores Collins
(74) *Attorney, Agent, or Firm*—Jenner & Block, L.L.C.

(57) ABSTRACT

A perpetual seal card game in which players purchase individual play cards and reveal indicia covered by removable covers. Indicia on the individual play cards indicate whether the player is an instant winner, continues playing as a challenging player or has lost the game. If the player is an instant winner, he receives a prize and is finished playing the game. If the player is a challenging player, he has an opportunity to challenge the prior game's winner. The challenging players identify themselves on a seal card containing a challenging player identification area and predetermined challenger indicia concealed by a removable cover. Once all of the challenging players have identified themselves, the predetermined challenger indicia is disclosed identifying the player who will challenge the prior game's winner. A second seal card, containing concealed indicia identifying the winner of the game, is used to determine the winner of the game. The cover concealing one of the indicia from the second seal card is removed to disclose the winner of the game. The winner of the game is automatically entered to play the next subsequent game without having to purchase an individual play card.

20 Claims, 3 Drawing Sheets

PERPETUAL SEAL CARD GAME

BACKGROUND OF INVENTION

1. Field of the Invention

This invention relates generally to a game system for playing games of chance for money and prizes and, more particularly, to a perpetual game of chance using a quantity of individual play cards and one or more seal cards to select one or more challengers and determine if the challengers defeat the prior game's winning player.

2. Description of Prior Art

The popularity of games of chance is undeniable. Whether operated by a government, casino, bingo hall, or tavern, these games can be a lucrative undertaking for both the player and the game operator. Games of chance come in a variety of styles to suit different players. One type is the paper-based small games of chance wherein symbols, letters, or numbers are imprinted on game cards to indicate whether the player has won the game. The symbols, letters, or numbers are concealed until the player purchases the card and removes the concealing means, revealing the results of the game. In this variety of game, a set of game cards is sold to the game operator who, preferably, sells all of the tickets in the set and uses the proceeds for the prizes. Once the prizes are awarded, the game operator keeps the remaining money as profit.

Over the years, manufacturers have developed a number of different paper-based small games of chance. For example, jar tickets are small folded and banded slips of paper that contain indicia of winning. Pull tab games, sometimes called break-open game cards, have one or more perforated tabs on the back of the card that can be removed to reveal indicia of winning.

Paper-based small games of chance are entertaining for the players because the games provide an opportunity for the player to win various sums of money or prizes for a limited cost. For the game operators, the games can be a source of revenue with a minimal initial investment. Since the cost of running and playing this type of game is minimal, many different groups use paper-based small games of chance as a source of income. Typically, game operators include gambling establishments, charitable groups, or private organizations. For gambling establishments such as bingo halls, this type of game can be a valuable extra source of revenue. Charitable groups benefit from these games through the income provided. For private organizations such as night-clubs or taverns, the entertainment of the patrons can be as beneficial as the added revenue the games produce.

As can be appreciated, the more entertaining the paper-based small games of chance are, the more successful the game operator will be. To make the games more appealing, manufacturers have produced games with an assortment of themes that might attract various people. In some cases, different forms of the same games have been developed. For example, a pull tab game may have a single removable area on the card, or it might contain several removable areas. In addition, some games may have more than one way of winning on a single ticket. One such example of this type of game is shown in Fienberg, U.S. Pat. No. 4,943,090. In these variations, the games are only single play games; therefore, once the game card has been opened the game is over.

Manufactures have built upon prior paper-based small games of chance to maintain a player's interest. One such game is the multi-level, or advanced play game. These games use the traditional single play game cards wherein some of the players are instant winners, while others qualify for advanced play. For additional or advanced play, the games use a special type of game card called a seal card. A seal card typically has a place for the qualified players to identify themselves and one or more concealed areas on the card. Once all of the qualifying players have been identified, the concealed areas are revealed to show a predetermined indicator of the game winner. After the winner is known, the game is completed. One such example of this type of game is shown in Quinlan, U.S. Pat. No. 5,671,921, assigned to the assignee of the present invention.

The present game system is a perpetual game of chance. The game system provides the player with a novel level of entertainment wherein the winner of the game is automatically entitled to play subsequent games without having to purchase another game card. This type of game system also benefits the game operator because it encourages the players to continue playing after the initial game has ended.

SUMMARY OF THE INVENTION

In accordance with the present game system, a quantity of individual play cards is sold to players for a predetermined price. The individual play cards contain indicia that are initially concealed from and subsequently revealed by the players. The indicia can be symbols, letters, or numbers, or any combination thereof. Some of the indicia indicate that the player is an instant winner and entitled to receive a predetermined prize. Other indicia indicate the player is a qualified challenging contestant and is qualified for a chance to defeat the prior game's winning player. Still other cards contain indicia that do not indicate any winning combination and, therefore, these players have lost the game.

One or more challenger seal cards are provided with one or more concealed areas under which is predetermined challenger indicia, identifying the player or players who will become the challenging players and will attempt to defeat the prior game's winning player. The challenger seal card may also contain a qualified challenger contestant identification area where the qualified challenging contestants can identify themselves. The indictor can be any identifying mark such as the player's name or other symbol to represent themselves. Once all of the qualified challenging contestants are identified, the concealed areas are revealed to show who will be the challenging players to challenge the prior game's winner. The challenging players also receive a prize.

One or more winning seal cards are provided with one or more concealed areas. The areas contain predetermined winning indicia that indicate each of the challenging players and the previous game's winning player. One of the concealed areas is reveal to show the chosen predetermined winning indicia. Based on the revealed indicia, one of the challenging players is the winning player to be defeated in the next game, or the current winning player continues as the winner. Whoever is the winning player of the current game receives a prize and is automatically entered into the next game.

DETAILED DESCRIPTION OF THE PREFERRED EMBODIMENT

1. Game System Set

Figure 2:
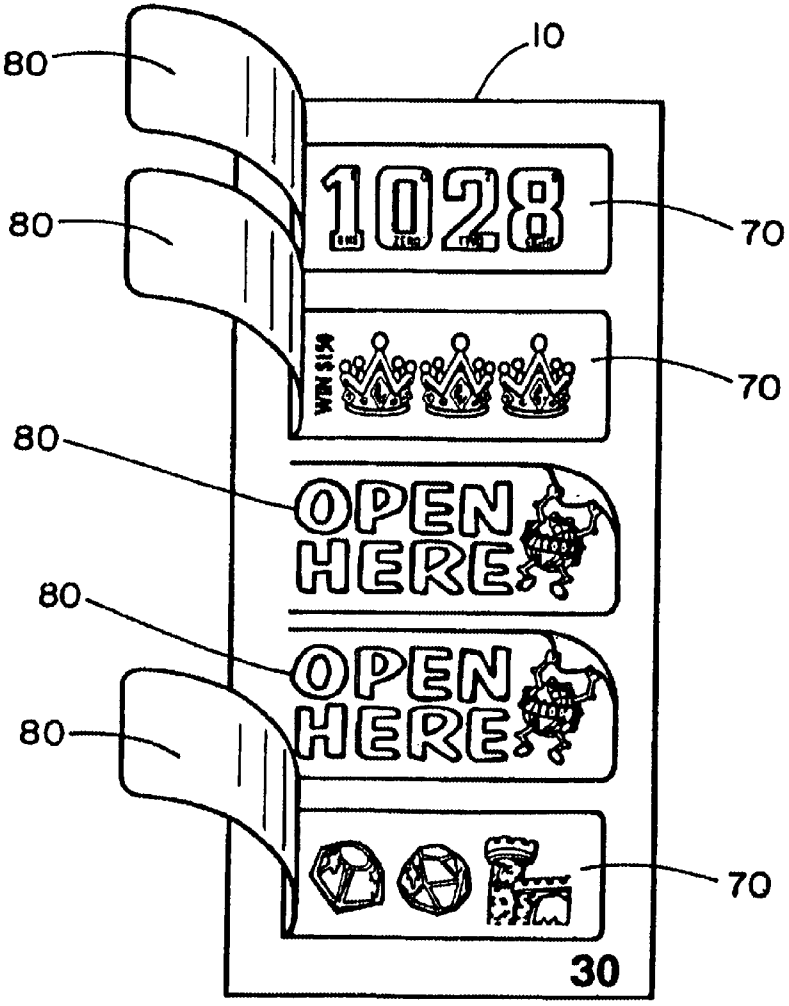
FIG. 2 is a back elevation view of an individual play card.
Figure 1:
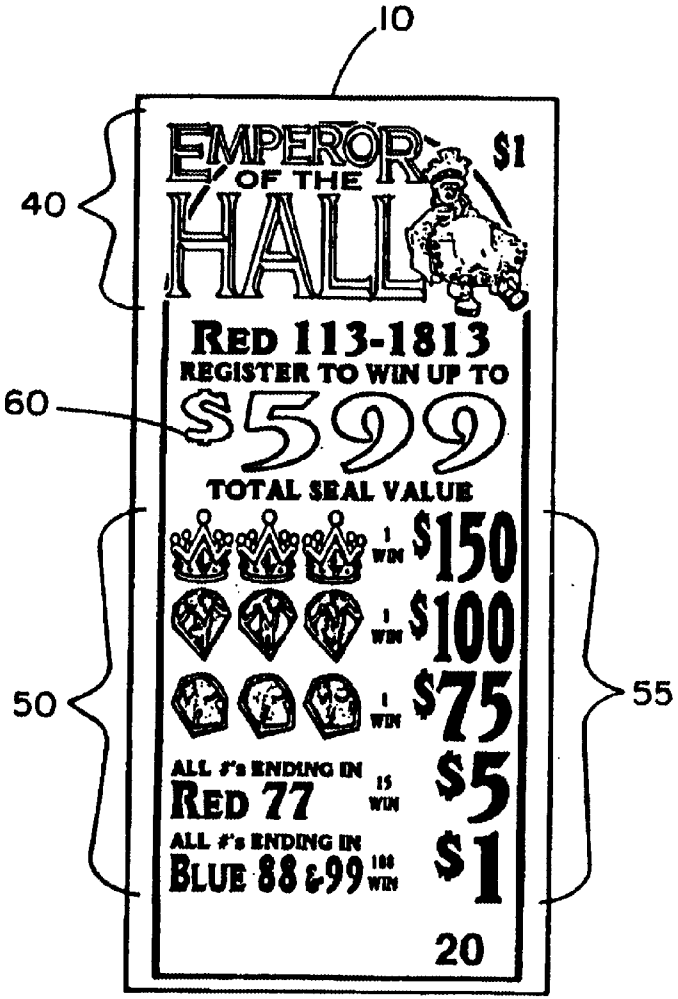
FIG. 1 is a front elevation view of an individual play card.

The following disclosure of the preferred embodiments is illustrative of the broad inventive concepts comprehended by the invention. Referring to FIGS. 1 and 2, therein is illustrated the individual play card 10 typically provided with the game system of the present invention. In the preferred embodiment, the individual play card 10 is constructed from a lamination of two plies of material; the front ply 20 and the back ply 30.

One side of the front ply 20 of the individual play card 10 may contain promotional information such as the name of the game 40, indicia of predetermined winning groups 50, the value for the predetermined winning groups 55, the total game value 60, or other graphic information. On the reverse side of the front ply 20 of the individual play card 10, opposite from the promotional information, are imprinted one or more indicia 70. The indicia 70 can be symbols, letters, numbers, or any combination thereof. This side of the front ply 20 is affixed to the back ply 30.

The back ply 30 of the individual play card 10 contains one or more selectively removable areas 80 created by perforations along three sides. Other methods for selectively removable areas are well known in the art. The selectively removable areas 80 are aligned with the indicia 70 on one side of the front ply 20 and conceal the contents of the individual play card 10 until a player removes the selectively removable area 80. This type of individual play card 10 is also known as a pull tab card.

Some individual play cards 10 contain combinations of indicia 70 imprinted on one side of the front ply 20 corresponding to the predetermined winning groups 50 on the opposite side of the front ply 20. The predetermined winning groups 50 represent predetermined prize values 55. Some other individual play cards 10 contain indicia 70 imprinted on one side of the front ply 20 that are predetermined qualifying challenger indicia 130. These indicia identify qualified challenging contestants. Still other individual play cards 10 contain indicia 70 that do not indicate the player is a game winner or qualified challenging contestant.

Figure 3:
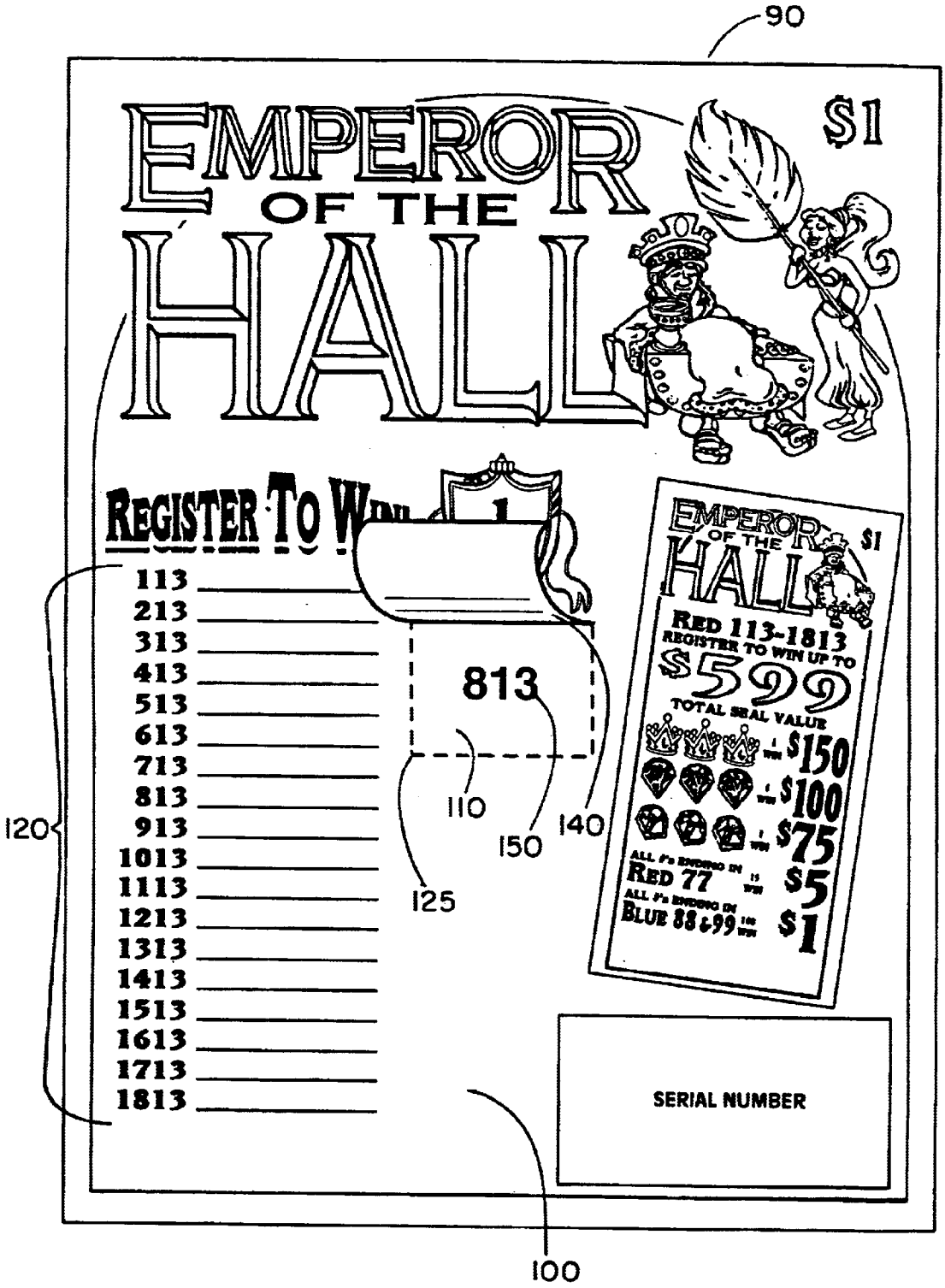
FIG. 3 is a front elevation view of a seal card used to select the challenger of the prior game's winner.

The challenger seal card 90 (see FIG. 3) is composed of a lamination of an upper ply 100 and a lower ply 110. The upper ply 100 contains a qualified challenger contestant identification area 120, which is capable of listing every qualified challenging contestant. The area 120 has a list of all predetermined qualifying challenger indicia 130 that identifies the qualified challenging contestant. Next to each predetermined qualifying challenger indicia 130 is a line for qualified challenging contestants to identify themselves. The upper ply 100 also contains a challenger selection area 125 that has selectively removable covers 140, which conceal predetermined challenger indicia 150. The selectively removable covers 140 are created by perforations around at least three sides and can be removed to reveal the lower ply 110. In addition, other promotional information may be imprinted on the upper ply 100.

The lower ply 110 of the challenger seal card 90 contains predetermined challenger indicia 150. The two plies are laminated together such that the predetermined challenger indicia 150 on the lower ply 110 is aligned with the selectively removable covers 140 on the upper ply 100. Initially, the selectively removable covers 140 conceal the predetermined challenger indicia 150. Once the selectively removable covers 140 are removed, the predetermined challenger indicia 150 is revealed.

Figure 4:
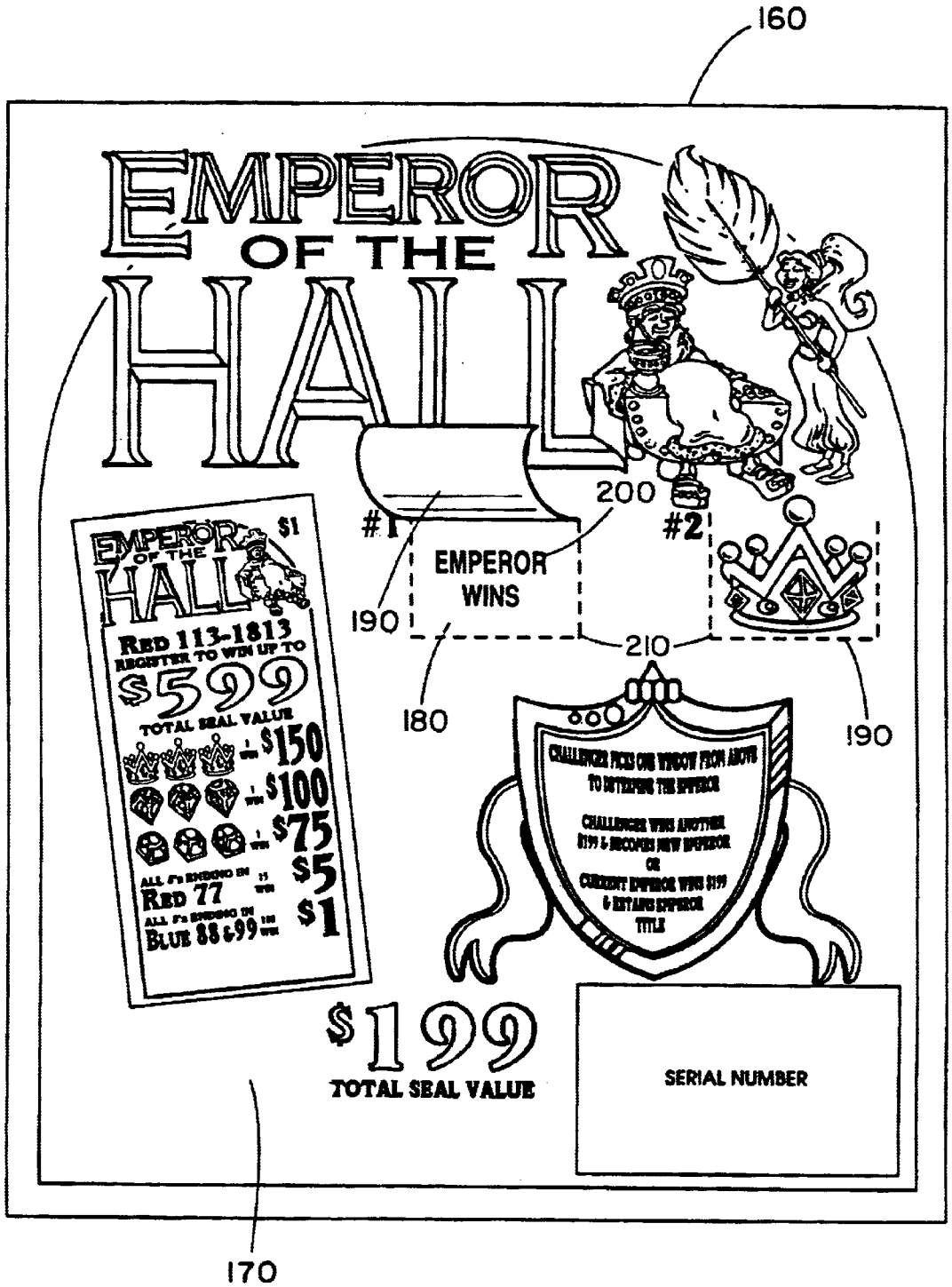
FIG. 4 is a front elevation view of a seal card used to determine if the challenger defeated the prior game's winner.

The winning seal card 160 (see FIG. 4) is also composed of a lamination of an upper ply 170 and a lower ply 180, and contains a winning selection area 210. The winning selection area 210 of the upper ply 170 contains two selectively removable covers 190, each created by perforations on at least three sides of the selectively removable covers 190. The lower ply 180 contains predetermined winning indicia 200 indicating the game's winning player. The predetermined winning indicia 200 are composed of one indicator for every challenging player and one indicator for the previous game's winning player. The predetermined winning indicia 200 align with the selectively removable covers 190 such that the predetermined winning indicia 200 are initially concealed. When one of the selectively removable covers 190 is taken away, the predetermined winning indicia 200 is revealed identifying the game's winning player. In addition to the winning selection area 210, the upper ply 170 of the winning seal card 160 can contain promotional information about the game.

2. Game System Play

In the preferred embodiment, the game is played with a plurality of individual play cards 10, a challenger seal card 90, and a winning seal card 160. The number of individual play cards 10 is dependent on several factors such as gaming regulations, the duration of the game, the player's purchase price of individual play cards 10, and the value of the prizes. It is preferable that all of the individual play cards 10 have been purchased before the game continues.

The individual play cards 10 contain indicia 70 under the selectively removable areas 80 on the card back 30. One or more—typically five—such selectively removable areas 80 are on the back 30 of each individual play card 10. The player removes the selectively removable areas 80 to reveal the indicia 70. Some of the cards contain predetermined winning groups of indicia 50. The player who reveals these predetermined winning groups 50 is an instant winner, and receives a prize corresponding to the value for the predetermined winning groups 55. As soon as the predetermined winning group 50 is revealed, the instant winner is done playing the game. In the illustrated embodiment the predetermined combination value 55 ranges from $1 to $150. Other cards contain indicia corresponding to a series of predetermined qualifying challenger indicia 130. If a player removes the selectively removable area 80 of his card and reveals one of the predetermined qualifying challenger indicia 130, he becomes a qualified challenging contestant and entitled to continue the game. Still other cards contain indicia 70 that do not correspond to predetermined winning groups 50 or predetermined qualifying challenger indicia 130. Players with these cards are done playing the game.

Those players, who have received cards with predetermined qualifying challenger indicia 130 and are qualified challenging contestants, identify themselves in the qualified challenger contestant identification area 120 on the challenger seal card 90. To identify themselves the qualified challenging contestants can write their name, or other identifying mark on the line next to the list of predetermined qualifying challenger indicia 130 corresponding to the predetermined qualifying challenger indicia 130 revealed on their individual play card 10. Once the qualified challenger contestant identification area 120 is completely filled, thereby identifying all qualified challenging contestants, the selectively removable cover 140 in the challenger selection area 125 of the challenger seal card 90 is removed to reveal the predetermined challenger indicia 150. The predetermined challenger indicia 150 is one of the predetermined qualifying challenger indicia 130. The player who has an individual play card 10 with a number that corresponds to the predetermined challenger indicia 150 becomes the challenging player and is qualified to challenge the prior game's winning player. The challenging player also receives a prize for becoming the challenging player, while the other qualified challenger contestants are done playing the game.

If the present game is the first time the game is played, or the previous game's winning player is not available to play the present game, the challenging player becomes the winning player. If a winning player exists from the immediately proceeding game, the challenging player will attempt to defeat the prior game's winning player. One of the selectively removable covers 190 from the winning selection area 210 is removed to reveal predetermined winning indicia 200 indicating whether the challenging player is the winner, or whether the prior game's winning player continues as the winner.

The game's winning player is awarded a prize. In the illustrated embodiment, the winner is entitled to $199. If the challenging player is the winner, this prize is in addition to the prize the challenging player was awarded for becoming the challenging player. The game then repeats itself with the game's winning player automatically continuing on to the next game.

Optionally, a winning insignia, such as a badge, medal, pin, crown or robe, may be included. When the game's winning player is identified, he is crowned the "Emperor" and entitled to wear the winner insignia until he is dethroned. The challenger in the next game attempts to overthrow the Emperor. This type of theme increases the friendly competition and, therefore, increases the entertainment value of the game.

The game has considerable entertainment value because of the perpetual nature of the game. Since the game will generally be played where the players know each other, such as a fraternal or civic organization or a neighborhood tavern, a friendly competition will normally exist between the players. Because the field of players is reduced in a graduated way, the competitive character of the game is enhanced. Once a player is selected as the winner, there will be a natural desire to challenge the new winner. The entertainment value is further enhanced because the prior game's winner will have a 50% chance of winning another prize without being required to purchase additional individual play cards 10 or needing to qualify as a challenging player. The increased entertainment value of the present game system will consequently improve the value of the game for the game operator. As the game progresses, the operator will be able to sell more individual play cards 10, thereby increasing the game operator's profit.

In yet another embodiment of the present game system, the selectively removable areas and covers of the individual play cards and seal cards are replaced with a removable material. The removable material is scratched or rubbed off revealing the contents under the removable material. This type of removable material is well known in the art.

Whereas the present game system has been described with respect to specific embodiments thereof, it will be understood that various changes and modifications will be suggested to one of ordinary skill in the art, and it is intended that the invention encompass such changes and modifications as fall within the scope of the appended claims.

What is claimed:

1. A seal card game system for playing a perpetual seal card game, comprising:

a plurality of individual play cards;

each of said individual play cards containing one or more indicia printed thereon;

each of said individual play cards further containing one or more selectively removable areas for initially concealing said indicia prior to said individual play card's purchase, said selectively removable areas being removable by a player after purchase;

at least one of said individual play cards containing one or more said indicia wherein said indicia contained in said individual play cards correspond to at least one of a plurality of predetermined winning groups, each of said predetermined winning groups corresponding to a prize award; and at least one of said individual play cards containing one or more said indicia wherein said indicia contained in said individual play cards correspond to at least one of a plurality of predetermined qualifying challenger indicia, said predetermined qualifying challenger indicia identifying qualified challenging contestants;

one or more challenger seal cards to be used in conjunction with said individual play cards comprising a winner selection area containing one or more indicia corresponding to a predetermined winning indicia identifying the game winning player, concealed by a selectively removable cover to hide the predetermined winning indicia until said selectively removable cover is removed from said seal card, said predetermined winning indicia is of the predetermined qualifying challenger indicia;

wherein the player who obtains an individual play card and removes said selectively removable area disclosing indicia corresponding to said predetermined winning indicia concealed under the selectively removable cover on said challenger seal cards, becomes the winning player of the game; and wherein said winning player is automatically a player in the next subsequent game without requiring to purchase an additional individual play card.

2. The seal card game system according to claim 1 wherein said challenger seal cards further comprise a qualified challenger contestant identification area consisting of:

indicia corresponding to said predetermined qualifying challenger indicia; and a space adjacent to each said predetermined qualifying challenger indicia wherein said qualified challenging contestants who previously obtained an individual play card with said predetermined qualifying challenger indicia can identify themselves.

3. The seal card game system according to claim 1 wherein said winning player is given an award of greater value than any other player obtaining an individual play card.

4. The seal card game system according to claim 1 further comprising winner insignia wherein the winning player of said perpetual seal card game is entitled to wear said winner insignia until another winning player is named.

5. The seal card game system according to claim 1 wherein said individual play cards are constructed from two plies of material laminated together such that said selectively removable areas are constructed from the top ply of the two-ply lamination.

6. The seal card game system according to claim 1 wherein said individual play cards are constructed such that a removable material covers said selectively removable areas, and rubbing said removable material reveals said indicia.

7. A seal card game system for playing a perpetual seal card game, comprising:

a plurality of individual play cards;

each of said individual play cards containing one or more indicia printed thereon;

each of said individual play cards further containing one or more selectively removable areas for initially concealing said indicia prior to said individual play card's purchase, said removable areas being removed by a player after purchase;

at least one of said individual play cards containing one or more said indicia wherein said indicia contained in said individual play cards correspond to at least one of a plurality of predetermined winning groups, each of said predetermined winning groups corresponding to a prize award; and at least one of said individual play cards containing one or more said indicia wherein said indicia contained in said individual play cards correspond to at least one of a plurality of predetermined qualifying challenger indicia, said predetermined qualifying challenger indicia identifying qualified challenger contestants;

one or more challenger seal cards to be used in conjunction with said individual play cards comprised of:

one or more challenger selection areas containing one or more indicia corresponding to predetermined challenger indicia identifying the one or more challenging players to challenge the previous game's winning player, concealed by a selectively removable cover to hide said predetermined challenger indicia until said selectively removable cover is removed from said challenger seal cards, said predetermined challenger indicia is of the said predetermined qualifying challenger indicia; and wherein players who obtain an individual play card, remove said selectively removable area and discloses indicia corresponding to said predetermined challenger indicia concealed under said selectively removable cover on said challenger seal cards, become the challenging players to the previous game's winning player; and one or more winning seal cards to be used in conjunction with said individual play cards and said challenger seal cards comprising a winner selection area containing predetermined winning indicia indicating the winning player, each of said predetermined winning indicia is concealed by selectively removable cover wherein one said selectively removable cover is removed to reveal the winning player.

8. The seal card game system according to claim 7 wherein said challenger seal cards further comprises a qualified challenger contestant identification area comprised of:

indicia corresponding to predetermined qualifying challenger indicia; and a space adjacent to each said predetermined qualifying challenger indicia wherein qualified challenging contestants who previously obtained an individual play card with said predetermined qualifying challenger indicia can identify themselves.

9. The seal card game system according to claim 7 wherein said challenging players are given an award of greater value than any other player obtaining an individual play card.

10. The seal card game system according to claim 7 wherein said previous game's winning player is not required to obtain an individual play card to be entered in the game.

11. The seal card game system according to claim 7 wherein said previous game's winning player is given an award only if he is the winning player over the said challenging players and has not obtained an individual play card.

12. The seal card game system according to claim 7 further comprising winning insignia wherein the winning player of said perpetual seal card game is entitled to wear said winning insignia until another winning player is named.

13. The seal card game system according to claim 7 wherein said individual play cards are constructed from two plies of material laminated together such that said removable areas are the top ply of the two-ply lamination.

14. The seal card game system according to claim 7 wherein said individual play cards are constructed such that a removable material covers said removable areas, and rubbing said removable material reveals said indicia.

15. A seal card game system for playing a perpetual seal card game, comprising:

a plurality of individual play cards;

each of said individual play cards containing one or more indicia printed thereon;

each of said individual play cards further containing one or more selectively removable areas for initially concealing said indicia prior to said individual play card's purchase, said removable areas being removable by a player after purchase;

at least one of said individual play cards containing one or more said indicia wherein said indicia contained in said individual play cards correspond to at least one of a plurality of predetermined winning groups, each of said predetermined winning groups corresponding to a prize award; and at least one of said individual play cards containing one or more said indicia wherein said indicia contained in said individual play cards correspond to at least one of a plurality of predetermined qualifying challenger indicia, said predetermined qualifying challenger indicia identifying qualified challenging contestants;

one or more challenger seal cards to be used in conjunction with said individual play cards comprising one or more challenger selection area containing one or more indicia corresponding to predetermined challenger indicia identifying challenging players to challenge the previous game's winning player, concealed by selectively removable covers to hide said predetermined challenger indicia until said selectively removable covers are removed from said seal card, said predetermined challenger indicia is of the said predetermined qualifying challenger indicia; and one or more winning seal cards to be used in conjunction with said individual play cards and said challenger seal cards comprising a winner selection area containing one or more predetermined winning indicia indicating the winning player, each of said predetermined winning indicia are concealed by selectively removable covers.

16. The seal card game system according to claim 15 wherein:

if a previous game's winning player does not exist, or the previous game's winning player is not available, the player who obtains an individual play card, removes said selectively removable area and discloses indicia corresponding to said predetermined challenger indicia concealed under the selectively removable covers on said challenger seal cards, becomes the winning player and is automatically entered into the next subsequent game; and if a previous game's winning player does exist, or is available:

the players who obtain an individual play card, remove said selectively removable area and disclose indicia corresponding to said predetermined challenger indicia concealed under the said selectively removable covers on said challenger seal cards, become the challenging players to the previous game's winning player; and the said selectively removable covers over the said predetermined winning indicia are removed to reveal the winning player, said winning player is automatically entered in the next subsequent game.

17. The seal card game system according to claim 16 wherein said challenger seal cards further comprises a qualified challenger contestant identification area comprised of:

indicia corresponding to said predetermined qualifying challenger indicia; and a space adjacent to each of said predetermined qualifying challenger indicia wherein said qualified challenging contestants who previously obtained an individual play card with said predetermined qualifying challenger indicia can identify themselves.

18. The seal card game system according to claim 16 further comprising winning insignia wherein the winning player of said perpetual seal card game is entitled to wear said winning insignia until another winning player is named.

19. The seal card game system according to claim 16 wherein said individual play cards are constructed from two plies of material laminated together such that said selectively removable areas are constructed from the top ply of the two-ply lamination.

20. The seal card game system according to claim 16 wherein said individual play cards are constructed such that a removable material covers said selectively removable areas, and rubbing said removable material reveals said indicia.

* * * * *